United States Patent [19]

Ferrier

[11] 4,325,990

[45] Apr. 20, 1982

[54] ELECTROLESS COPPER DEPOSITION SOLUTIONS WITH HYPOPHOSPHITE REDUCING AGENT

[75] Inventor: Donald R. Ferrier, Thomaston, Conn.

[73] Assignee: MacDermid Incorporated, Waterbury, Conn.

[21] Appl. No.: 149,236

[22] Filed: May 12, 1980

[51] Int. Cl.[3] ..... C23C 3/02

[52] U.S. Cl. ..... 427/305; 106/1.23; 106/1.26; 427/437; 427/443.1

[58] Field of Search ..... 427/305, 437, 443.1; 106/1.23, 1.26

[56] References Cited

U.S. PATENT DOCUMENTS

| | | | |
|---|---|---|---|
| 3,046,159 | 7/1962 | Brookshire | 427/437 |
| 3,650,777 | 3/1972 | Schneble, Jr. et al. | 427/437 |
| 4,209,331 | 6/1980 | Kukanskis et al. | 106/1.23 |

OTHER PUBLICATIONS

Saubestre, "Electroless Copper Plating", Technical Proceedings of the Golden Jubilee Convention of American Electroplaters Society, vol. 46, pp. 264–265; 1959.

Pearlstein et al., "Electroless Copper Plating Using Dimethylamine Borane", Plating, May 1973, pp. 474–476.

Fintschenko et al., "Electroless Copper Plating", Metal Finishing Jan., 1970.

Calley et al., "Metallizing Polymeric Coatings", IBM TDB, vol. 12, No. 2, Jul. 1969.

*Primary Examiner*—John D. Smith

*Attorney, Agent, or Firm*—St. Onge, Steward, Johnston & Reens

[57] ABSTRACT

Suitably complexed cupric solutions can deposit conductive copper films electrolessly on properly catalyzed non-conductive substrates, at plating bath pH values in the range of about 2.0 to 3.5, using a non-formaldehyde reducer such as hypophosphite. Certain conditions are critical to successful results: (1) ability of the complexer selected to chelate copper at pH values of 2.0 to 3.5 at elevated temperatures (140° to 160° F.); (2) avoidance of certain anions, such as halides and acetates, in significant concentrations in the plating solution; and (3) provision of an "active" catalytic surface on the non-conductive substrate.

10 Claims, No Drawings

ELECTROLESS COPPER DEPOSITION SOLUTIONS WITH HYPOPHOSPHITE REDUCING AGENT

BACKGROUND OF THE INVENTION

1. Field of the Invention

The use of non-formaldehyde reducing agents of the hypophosphite type provide substantial advantage over some of the more conventional reducing agents, such as formaldehyde and the boro compounds, heretofore used almost exclusively in electroless copper plating. The use of hypophosphite type reducing agents in electroless copper solutions heretofore has, however, been restricted in practical commercial plating operations to baths of pH values generally well in excess of pH 5.0. This invention relates to improvements in electroless copper plating baths employing hypophosphite reducing agents, but having substantially lower pH operating ranges.

2. Description of the Prior Art

The predominant commercial practice in electroless deposition of copper, prior to the recent introduction of the hypophosphite electroless copper baths mentioned above, uses highly alkaline, complexed cupric solutions containing formaldehyde as the sole reducer. The volatility of formaldehyde, and its tendency to undergo the well-known, wasteful, Cannizzaro side reaction, and the long-term relative instability of formaldehyde-bearing copper plating solutions, have prompted the art to search for non-formaldehyde plating solutions.

U.S. patent application Ser. No. 909,209 filed May 25, 1978, now U.S. Pat. No. 4,209,331 provides one of the first disclosures enabling commercially practical use of hypophosphite reducing agents in electrolessly plating copper onto non-conductors. That application deals extensively with what prior art there is relating to hypophosphite-type electroless copper plating solutions, and that disclosure is incorporated herein by reference. Essentially, it was shown that while hypophosphite has gained industry-wide acceptance for depositing nickel in electroless plating operations, there were no commercial processes being successfully used to the inventors' knowledge in which hypophosphite agents were employed to electrolessly plate copper. It is disclosed in that application that by maintaining a specified complexer/pH relationship in the copper bath at pH values of 5.0 to 13.0, plating of copper with hypophosphite reducing agents is practical, and that the system has advantages for commercial operations.

It is taught in application Ser. No. 909,209, now U.S. Pat. No. 4,209,331 however, that at pH values below 5 copper deposition is virtually absent or is of little usefulness because the deposit has poor conductivity, is powdery, or both. Another troublesome complication that led to the foregoing conclusion is the appearance of a precipitate when the bath is heated to temperatures in the range of 140° to 160° F. Operation of a bath at this temperature is desired to minimize voids in the copper film deposited. It was previously believed that because of the ineffectiveness of most commercial organic chelating agents to strongly coordinate copper ions in solution at pH values below 5, there was little chance to overcome the difficulties of poor coating conductivity and low solution stability. In the aforesaid application, numerous examples document the basis for previously reaching that conclusion, the following being representative:

| | |
|---|---|
| Table A | Ex. 9, 10, 11, 12 |
| Table B | Ex. 30, 31, 32, 33 |
| Table C | Ex. 51, 52, 53, 54 |
| Table D | Ex. 64, 65, 66, 67 |

To the extent that applicant can find in the prior art any reference to hypophosphite-based, low pH (5 or less) electroless copper plating baths, such baths do not contain chelating agents. A case in point is U.S. Pat. No. 3,046,159 disclosing compositions of cupric oxide, ammonium sulfate or chloride, and sodium hypophosphite. The operating pH of the bath is given as 3.0; the operating temperature is given as 93° C. (200° F.). However it is found in practicing the invention in accordance with the teaching of the patent that the deposits formed are powdery, have poor adhesion and are poorly conducting, and burn off if attempt is subsequently made to build them up to useful thicknesses by electroplating techniques.

In another reference, IBM Technical Disclosure Bulletin, Vol. 12, No. 2, dated July 1969, it is confirmed that a bath quite similar to the one described in U.S. Pat. No. 3,046,159 produces a deposited film "the conductivity of which is not very high." The bulletin goes on to recommend that in order to produce a conductive layer, "the plating is continued in an alkaline electroless copper bath;" i.e. a conventional formaldehyde containing bath.

In another reference, U.S. Pat. No. 3,650,777, fleeting reference is made to possible use of hypophosphite in acidic electroless copper plating baths (see Column 2, lines 15–17) without, however, teaching how this is accomplished and without giving a single example of a bath to illustrate any reduction to practice.

In summary, therefore, the foregoing patents and technical literature typically illustrate prior art teaching in respect to the difficulties of attempting to use hypophosphite as a reducing agent for electroless copper plating at low pH value, and the conclusion advanced has been that the principal difficulties are poorly conductive powdery copper films and bulk-precipitation of insoluble particles, which make such a bath inoperative for practical applications.

SUMMARY OF THE INVENTION

The invention here relates to the discovery that hypophosphite reducing agents can be usefully employed as reducing agents for divalent copper at a bath pH of about 2.0 to 3.5, to produce an electrically conductive copper film on a suitably catalyzed non-conductive substrate. Such copper deposit has good conductivity, provides good adherence of the deposit to the substrate, and serves as an excellent base for further electrolytic deposition of additional copper or other metals.

It has been discovered that the undesirable results causing difficulty in the prior art teachings were due primarily to presence of chloride ion in the bath, introduced through the use of cupric chloride as the main copper-bearing constituent of the bath. Other anions such as bromide, iodide, fluoride and acetates in the bath composition will likewise prevent deposition of conductive copper film in the range of 2 to 5 pH in hypophosphite-based copper metallizing solutions.

There is the further requirement of course that a suitable complexer be selected which will allow some coordination of copper at this pH range.

The reason why chloride and other ions mentioned above interfere with proper functioning of hypophosphite-based copper metallizing baths is not properly understood at this time. It is theorized that these interfering ions somehow stabilize the cuprous state and make the reaction $$Cu_{+} + e \rightarrow Cu^{\circ}$$

kinetically more difficult. This however is only an assumption and the significant finding of the present invention is that, being made aware of the deleterious effect of certain anions in these bath solutions, those skilled in the art are now enabled to make component selection which permits utilizing hypophosphite reducing agents in electroless copper plating baths operating at the low pH values mentioned; i.e. below 5.0.

DESCRIPTION OF PREFERRED EMBODIMENTS

Plating solutions embodying the invention concept include the usual major categories of components; namely, a source of cupric ions and a solvent for these, usually water; complexing agent or mixtures thereof; and hypophosphite reducing agent.

The most effective complexing agents now known for the electroless copper baths of the invention are N-hydroxyethyl ethylenediamine triacectic acid (HEEDTA), ethylenediamine tetraacetic acid (EDTA), nitrilotriacetic acid (NTA), and alkali metal salts of these. These complexors will provide an electrically conductive copper film on a properly catalyzed nonconductive substrate in the pH range of 2 to 3.5, provided detrimental anions are not in solution.

The major area of introducing interfering anions into the plating solution is the source of copper (cupric ion) used. We have found that cupric sulfate, nitrate or fluorborate can be used, and in contrast the cupric halides such as chloride, bromide, etc., also acetate, should be avoided as these will not allow deposition of an electrically conductive copper film when they are significantly present in solution.

To maintain the pH in the preferred range, standard acid or alkaline adjustments can be used, such as by addition of sulfuric acid to lower pH and sodium or potassium hydroxide to raise pH. However, an acid or base which would introduce one of the detrimental anions, for example hydrochloric acid, must be avoided to keep the bath operative.

Concentrations of components can have a wide range and can be optimized within the range to produce the preferred conditions. The concentration of the amine complexors such as EDTA and HEEDTA in solution is preferably at about one-to-one on a mole ratio basis with the cupric ion, while the NTA complexor is preferably on a two-to-one mole ratio with the cupric ion. Lesser amounts of complexor will of course leave some copper uncomplexed. This can be tolerated within limits, provided precipitation of particles is insufficient to interfere with the desired degree of luster, smoothness, etc. in the finished plate. On the higher ratio side, there is no problem, as excess of complexor does not hinder the operation of the bath and in fact a slight excess can be helpful to accommodate for conditions of temporary, locally high copper concentration which may arise during bath replenishment operations.

Sodium hypophosphite is the most readily available hypophosphite material and is accordingly the preferred form of this reducing agent. Hypophosphorous acid however is also available and could be used in conjunction with pH adjusters which might be required when using the acid. As to concentration, the optimum level is that which is sufficient to give an adequate copper film. Working with large excess of reducer in solution does not normally impede bath operation, but neither does it offer any advantage.

The following examples illustrate preferred conditions for practicing the invention.

EXAMPLE 1

A typical workpiece comprising an automotive component molded of standard commercial plating grade ABS is first cleaned to remove surface grime, oil, etc. An alkaline cleaning solution is typically used here. This is followed by chemical etch using mixed chromic-sulfuric or all chromic acid, also standard in the industry. Typical operating conditions, concentrations and time of treatment are disclosed in U.S. Pat. No. 3,515,649. Following thorough rinsing, the workpiece is catalyzed. This can be accomplished in the "one-step" method using a mixed palladium-tin catalyst of commercial type. Such a catalyst is disclosed in U.S. Pat. No. 3,352,518, along with its method of use. Following rinsing, the catalyzed workpiece is next placed in a so-called "accelerating solution." Again many types of accelerating baths can be employed, for example the one disclosed in the above mentioned U.S. Pat. No. 3,352,518, such accelerating baths generally consisting of an acid solution. Alkaline accelerators such as sodium hydroxide solution have also been used successfully.

The workpiece is then ready after further rinsing for copper plating. The novel copper bath used in this example has the following composition:

| | |
|---|---|
| $CuSO_4 . 5H_2O$ | 0.04M |
| "Hamp-OL" (HEEDTA) | 0.05M |
| $NaH_2PO_2 . H_2O$ | 0.34M |
| Water | |
| pH adjuster ($H_2SO_4$/NaOH) | pH 3 |

The bath is maintained at 155° F. (68° C.) and when the work is immersed in it for 10 minutes, the thickness of copper plate obtained is 11 microinches. In 30 minutes the thickness of deposit is 24 microinches. The deposit is bright pink, a visual characteristic indicating good electrical conductivity. Coverage is complete on the catalyzed surface, and the deposit is well-adhered and is free of blisters and roughness. This electroless plated substrate is rinsed, then placed in a standard electrolytic copper strike bath similar to any of those described in U.S. Pat. Nos. 3,203,878, 3,257,294, 3,267,010 or 3,288,690, for example. Initially the electroplating is carried out at about 2 volts at a rate of about 20 amperes per square foot. Generally this is maintained for about 1½ minutes, or until the thickness of deposit is sufficient to provide greater current-carrying capability. At such time the plating rate may then be increased, as for example to about 4 volts at 40 amperes per square foot, and is continued until the total required thickness of copper is obtained. The workpiece may be further electroplated with nickel, chromium, gold, etc., as may be required for any given application, using standard electroplating techniques. Much of the restriction on initial current density depends on the size and physical complexity of parts, along with the amount of rack contact area available per area of workpiece. If enough contacts are used, the need to monitor initial current densities is less critical; however in production experience, adequate rack contacts cannot always be found.

Peel strength tests on plated workpieces obtained from baths in accordance with this example show adherence values of about 8–10 pounds per inch for the copper deposit on ABS substrates. Similar levels of peel strength are obtained for other thermoplastic substrates including polyphenylene oxide, polypropylene, etc., as well as thermosetting substrates such as phenolic, epoxy, etc.

EXAMPLE II

An electroless copper bath identical in all respects to that of the foregoing example is prepared except that a different complexor is used. In this case, the complexor is "Hampene $Na_4$" (tetrasodium EDTA) at the same concentration (0.05M) as before and the pH is again 3. At a bath temperature of 155° F., a bright pink electroless copper deposit of 11 microinches is obtained in 10 minutes, which increases to 25 microinches in 30 minutes. Coverage of the workpiece is complete on the catalyzed surface, and the deposit is free of blisters and roughness and is well adhered to the substrate. The deposit forms an excellent base for further metal plating to build up a desired total thickness. When so plated, adhesion tests made on the ABS substrate plated in accordance with this example show peel strengths which range from 8–10 pounds per inch.

EXAMPLE III

Another ABS workpiece is prepared for electroless plating in the manner described. The electroless copper bath here is again identical to that of the first example except for complexor, which in this case is nitrilotriacetic acid (NTA) at 0.10M. At a solution pH of 3, a bright pink adherent copper deposit of 14 microinches is obtained in 10 minutes, and 27 microinches in 30 minutes. After being further plated with additional copper, nickel, chromium or the like, to build up a desired thickness, adhesion values of 8–10 pounds per inch peel strength on ABS is recorded.

EXAMPLE IV

Another ABS workpiece is prepared for electroless plating as described in Example I. The electroless copper bath here is again identical to that of Example I except for the copper salt, which in this case is copper fluoborate at 0.04M. At a solution pH of 3, a bright pink adherent copper deposit of 14 microinches is obtained in 10 minutes, and 29 microinches in 30 minutes. After being further plated with additional copper, nickel, chromium or the like, to build a desired thickness, adhesion values of 8–10 pounds per inch peel strength on ABS is recorded.

EXAMPLE V

Another ABS workpiece is prepared for electroless plating as described in Example I. The electroless copper bath here is identical to that of Example II except for the copper salt which in this case is copper fluoborate at 0.04M. At a solution pH of 3, a bright pink adherent copper deposit of 12 microinches is obtained in 10 minutes, and 26 microinches in 30 minutes. After being further plated with additional copper, nickel, chromium or the like, to build a desired thickness, adhesion values of 8–10 pounds per inch peel strength on ABS is recorded.

EXAMPLE VI

Another ABS workpiece is prepared for electroless plating as described in Example I. The electroless copper bath here is again identical to that of Example I except for the copper salt which in this case is copper nitrate at 0.04M. At a solution pH of 3, a good pink adherent copper deposit of 12 microinches is obtained in 10 minutes. After being further plated with additional copper, nickel, chromium or the like, to build a desired thickness, adhesion values of 8–10 pounds per inch peel strength on ABS is recorded.

EXAMPLE VII

Another ABS workpiece is prepared for electroless plating as described in Example I. The electroless copper bath here is again identical to that of Example I except for the copper salt which in this case is copper chloride at 0.04M. At a solution pH of 3, no plating of a conductive copper film was obtained.

EXAMPLE VIII

Another ABS workpiece is prepared for electroless plating as described in Example I. The electroless copper bath here is again identical to that of Example I except for the copper salt which in this case is copper acetate at 0.04M. At a solution pH of 3, a dark brownish black film formed on the workpiece. The film was not appreciably conductive, and not useful for subsequent electroplating.

EXAMPLE IX

Another ABS workpiece is prepared for electroless plating as described in Example I. The electroless copper bath here is again identical to that of Example I except that the copper salt in this case is copper bromide at 0.04M. At a solution pH of 3, no plating of a conductive copper film was obtained.

In order to illustrate the effect of varying concentration of the major bath constituents, such as the copper concentration and the reducer concentration, Table A gives a summary of results along these lines. The table shows that a wide variation of the copper concentration and reducer concentration can be utilized and still give good pink, conductive copper films. This is a positive benefit for commercial installations where varying parameters are experienced.

TABLE A

| | MOLAR CONCENTRATIONS | | | | ELECTROLESS DEPOSIT | | | |
|---|---|---|---|---|---|---|---|---|
| Ex. | $Cu(BF_4)_2$ | HEEDTA | $NaH_2PO_2 \cdot H_2O$ | pH | Time (Min.) | Thickness in. | Temp. °F. | Color |
| A | .04 | .05 | .17 | 3.0 | 10 | 9 | 155 | Pink |
| B | .04 | .05 | .17 | 3.0 | 30 | 29 | 155 | Pink |
| C | .04 | .05 | .34 | 3.0 | 10 | 12 | 155 | Pink |

TABLE A-continued

| Ex. | MOLAR CONCENTRATIONS $Cu(BF_4)_2$ | HEEDTA | $NaH_2PO_2 \cdot H_2O$ | pH | ELECTROLESS DEPOSIT Time (Min.) | Thickness in. | Temp. °F. | Color |
|---|---|---|---|---|---|---|---|---|
| D | .04 | .05 | .34 | 3.0 | 30 | 20 | 155 | Pink |
| E | .04 | .05 | .51 | 3.0 | 10 | 9 | 155 | Pink |
| F | .04 | .05 | .51 | 3.0 | 30 | 16 | 155 | Pink |
| G | .08 | .10 | .17 | 3.0 | 10 | 8 | 155 | Pink |
| H | .08 | .10 | .17 | 3.0 | 30 | 17 | 155 | Slightly Dk. Pink |
| I | .08 | .10 | .34 | 3.0 | 10 | 14 | 155 | Pink |
| J | .08 | .10 | .34 | 3.0 | 30 | 22 | 155 | Pink |
| K | .08 | .10 | .51 | 3.0 | 10 | 11 | 155 | Pink |
| L | .08 | .10 | .51 | 3.0 | 30 | 21 | 155 | Pink |
| M | .12 | .15 | .17 | 3.0 | 10 | 8 | 155 | Pink |
| N | .12 | .15 | .17 | 3.0 | 30 | 19 | 155 | Slightly Dk. Pink |
| O | .12 | .15 | .34 | 3.0 | 10 | 13 | 155 | Pink |
| P | .12 | .15 | .34 | 3.0 | 30 | 26 | 155 | Pink |
| Q | .12 | .15 | .51 | 3.0 | 10 | 13 | 155 | Pink |
| R | .12 | .15 | .51 | 3.0 | 30 | 23 | 155 | Pink |

Experimentation was conducted to determine the parameter of pH for the various workable anions. In general the optimum pH appears to be about 3, with a workable range of about 2.0–3.5. As the pH is lowered from 3 to 2 the bath stability begins to lessen, and at pH of about 2.0–2.5 we have found that air agitation (oxygen stabilization) is necessary to prevent bulk precipitation (instability) of copper from solution. At pH below 2 the complexors apparently discontinue coordination with the copper, in fact EDTA precipitates out of solution at pH less than 2. As the pH increases from 3 to 3.5, the copper film deposited begins to get darker until at pH more than 3.5, the films produced are brownish and sometimes black, and are not suitable for subsequent electroplating.

The data presented in the foregoing examples is based on use of standard platable grade of ABS substrate used in plating of plastics with conventional formaldehyde-type electroless copper baths. Tests made on other substrates molded of standard plating grade thermoplastics, such as "Noryl" (polyphenylene oxide) and polypropylene, show that the invention baths are applicable to those as well. Also thermosetting substrates of the phenol-formaldehyde as well as epoxy types can be plated in the invention baths, as can other types of thermoset plastics.

The invention is especially applicable to plating on plastics; that is, to applications where the plated part or workpiece is required to have a metal finish for decorative or protective purposes. Automobile, appliance and hardware parts are fields in which such applications more frequently arise. In such applications it is usually most practical to apply, initially, a thin deposit of copper by electroless deposition, after which additional thicknesses of copper, nickel, chromium, for example, or other metal can be added more rapidly and economically by standard electrodeposition procedures. The hypophosphite-reduced electroless copper baths of this invention are particularly suited for such applications. In this system the plating rate of copper on palladium/-tin catalyzed plastic substrates is initially fast but slows as the copper thickness builds. It is assumed that this occurs because the copper deposit produced in the bath is not as catalytic to the system as is the palladium/tin. This however is an advantage in situations requiring only a thin conductive copper coating, as in plating on plastics, since any extraneous plate-out on tank walls, racks, heater coils, etc. will be inherently self-limiting in the novel baths, and therefore reduces the extraneous plate-out loss, tank clean-out and rack maintenance problems.

The preparation of the surface of the substrate, particularly for plating on plastic applications, generally includes the chromic-sulfuric or all-chromic etch procedure mentioned above of bare plastic surfaces. The copper baths of the invention can be used, however, for printed circuitboard applications employing, for example, the "PLADD" process of MacDermid Incorporated, Waterbury, Conn., disclosed in U.S. Pat. No. 3,620,933. In that system, a different substrate preparation is used, preliminary to electroless deposition of the copper. This is illustrated by the following example.

EXAMPLE X

The workpiece here is to comprise a printed circuitboard which takes the form initially of a blank laminate consisting of aluminum foil bonded to a fiber-glass reinforced epoxy resin substrate. In preparing the circuitboard, this blank laminate is placed in a hydrochloric acid bath to chemically strip off the aluminum foil, leaving the surface of the resin substrate especially suited for subsequent reception of electroless metal deposition. This preliminary operation replaces the chromic-sulfuric etch step mentioned previously. The stripped substrate, after careful rinsing, is then catalyzed, following the same procedure of palladium-tin catalysis described in Example I. The catalyzed board is then copper plated, using the same copper solution described in that earlier example. This produces a thin copper deposit across the entire surface of the substrate. A mask or resist is then applied, as by screening, photopolymeric development, etc., to define a desired printed circuit. The masked (thinplated) substrate is then further plated in an electrolytic bath, using the initial electroless deposit as a "bus" to build up additional metal thickness in the unmasked regions of the circuitboard. The resist or mask is next chemically dissolved and the board is placed in a suitable copper etchant solution, such as that disclosed in U.S. Pat. No. 3,466,208, for a time sufficient to remove the thin initial copper deposit previously covered by the resist, but insufficient to remove the substantially thicker circuit-defining regions of copper (or other metal) built up in the electrolytic plating bath. This technique is sometimes referred to in the art as a semi-additive plating process.

In similar manner, the invention is applicable to the "subtractive" procedure for preparation of printed circuitboards having through-holes for interconnecting conductor areas on opposite surfaces of standard copper foil clad laminates. The through-holes are punched in the blank board and the walls of the through-holes plated with copper electrolessly, using the copper solution of this invention after proper catalization of the substrate. Additional thickness of the wall deposit can be provided by electrolytic deposition, if desired. A resist is applied to produce a prescribed circuit pattern, and any exposed copper foil is then etched away, leaving the circuit pattern and through-hole interconnections. The resist may or may not then be removed, depending on further plating requirements, such as gold plating of connector tab areas on the circuit, solder coating, etc.

Although specific embodiments of the present invention have been described above in detail, it is to be understood that these are primarily for purposes of illustration. Modifications may be made to the particular conditions and components disclosed, consistent with the teaching herein, as will be apparent to those skilled in the art, for adaptation to particular applications.

We claim:

1. An electroless copper deposition solution comprising, in addition to water, a soluble source of cupric ions, a complexing agent effective to maintain said cupric ions in solution at pH levels below 5.0, and a reducing agent effective to reduce cupric ions to copper as a deposited conductive metal film on a catalyzed nonconductive surface of a substrate when in contact with said solution, wherein said reducing agent is a soluble source of hypophosphite ions; said solution having a pH of from about 2.0 to 3.5 and said complexing agent being selected to be effective for coordination with said cupric ions within that range to prevent their precipitation from said solution, wherein said solution is free of significant concentrations of anions which would interfere if present with the reduction of the cupric ions by said hypophosphite reducing agent to produce said conductive copper film on a catalyzed surface of a substrate placed in contact with said solution.

2. An electroless copper deposition solution as defined in claim 1, wherein said solution is essentially free of interfering ions of the group consisting of halides and acetates.

3. An electroless copper deposition solution as defined in claim 2, wherein said complexing agent is selected from the group consisting of HEEDTA, EDTA and NTA.

4. An electroless copper deposition solution as defined in claims 2 or 3, wherein said soluble source of cupric ions is selected from the group consisting of cupric sulfate, cupric fluoroborate and cupric nitrate.

5. An electroless copper deposition solution as defined in claim 3, wherein the mole ratio of HEEDTA and EDTA to cupric ion is about one-to-one, and the mole ratio of NTA to cupric ion is about two-to-one.

6. A method of electrolessly depositing a copper plating on the surface of a substrate comprising the steps of preparing the surface of the substrate to render it more receptive to plating, immersing the substrate in a plating solution comprising, in addition to water, a soluble source of cupric ions, a complex-agent effective to maintain said cupric ions in solution at pH levels below 5.0, and a reducing agent effective to reduce said cupric ions to copper as a deposited metal conductive metal film on the prepared surface of the substrate when in contact with the solution, wherein said reducing agent is a soluble source of hypophosphite ions; selecting said complexing agent to be effective at pH levels of 2 to 3.5 for complexing the cupric ions and maintaining said solution free of significant concentrations of anions which would interfere if present with the reduction of the cupric ions by said hypophosphite reducing agent to produce said conductive copper film on the substrate.

7. A method of electrolessly depositing a copper film on the surface of a substrate as defined in claim 6, wherein said plating solution is maintained substantially free of interfering anions of the group consisting of halides and acetates.

8. A method of electrolessly depositing a copper film on the surface of a substrate as defined in claim 7, wherein said complexing agent is selected from the group consisting of HEEDTA, EDTA and NTA.

9. A method of electrolessly depositing a copper film on the surface of a substrate as defined in claims 7 or 8, wherein said soluble source of cupric ions is selected from the group consisting of cupric sulfate, cupric fluoroborate and cupric nitrate.

10. A method of electrolessly depositing a copper film on the surface of a substrate as defined in claim 8, wherein the mole ratio of HEEDTA and EDTA to cupric ion is about one-to-one, and the mole ratio of NTA to cupric ion is about two-to-one.

* * * * *

UNITED STATES PATENT AND TRADEMARK OFFICE

CERTIFICATE OF CORRECTION

PATENT NO. : 4,325,990

DATED : April 20, 1982

INVENTOR(S) : Donald R. Ferrier et al.

It is certified that error appears in the above—identified patent and that said Letters Patent is hereby corrected as shown below:

On the title page, Inventors should read:

-- Donald R. Ferrier, Thomaston, Conn.; Harold L. Rhodenizer, Bethlehem, Conn.; Peter E. Kukanskis, Woodbury, Conn.; John J. Grunwald, Tel-Aviv, Israel --.

Signed and Sealed this

*Fourteenth* Day of *September 1982*

[SEAL]

*Attest:*

GERALD J. MOSSINGHOFF

*Attesting Officer*

*Commissioner of Patents and Trademarks*